US009091450B2

(12) United States Patent
Ritchie

(10) Patent No.: US 9,091,450 B2
(45) **Date of Patent: *Jul. 28, 2015**

(54) EVAPORATIVE AIR CONDITIONING SYSTEM

(75) Inventor: Michael Charles Ritchie, Las Vegas, NV (US)

(73) Assignee: Coolfactor, LLC, Las Vegas, NV (US)

( * ) Notice: Subject to any disclaimer, the term of this patent is extended or adjusted under 35 U.S.C. 154(b) by 251 days.

This patent is subject to a terminal disclaimer.

(21) Appl. No.: 13/586,666

(22) Filed: Aug. 15, 2012

(65) Prior Publication Data

US 2014/0047858 A1 Feb. 20, 2014

(51) Int. Cl.
*F28D 5/00* (2006.01)
*F24F 5/00* (2006.01)

(52) U.S. Cl.
CPC ..... *F24F 5/0035* (2013.01); *F28D 5/00* (2013.01)

(58) Field of Classification Search
CPC .. F24F 5/0035; F24F 2001/0088; F25D 5/00; Y02B 30/545; F28D 7/024; F28D 7/106; F28D 7/1615; F28D 5/00
USPC ..... 62/314, 100, 186, 411, 414, 259.4
See application file for complete search history.

(56) References Cited

U.S. PATENT DOCUMENTS 2,557,276 A * 6/1951 Gerow ..... 261/28
2,741,105 A * 4/1956 Stratton ..... 62/314
4,090,370 A * 5/1978 Vaughan ..... 62/91
4,380,910 A * 4/1983 Hood et al. ..... 62/91
4,910,971 A * 3/1990 McNab ..... 62/310
5,263,337 A * 11/1993 McMillan et al. ..... 62/304
5,509,275 A * 4/1996 Bhatti et al. ..... 62/271
5,598,719 A * 2/1997 Jones et al. ..... 62/304
5,606,868 A * 3/1997 Calvert ..... 62/315
6,293,121 B1 * 9/2001 Labrador ..... 62/304
6,354,103 B2 3/2002 Evans, Sr.
6,371,388 B2 * 4/2002 Utter et al. ..... 239/419
6,408,633 B1 6/2002 Carr
6,598,862 B2 * 7/2003 Merrill et al. ..... 261/128

(Continued)

FOREIGN PATENT DOCUMENTS

JP 2009115335 A 5/2009
RU 2056591 C1 3/1996

(Continued)

OTHER PUBLICATIONS

Non-Final Office Action for U.S. Appl. No. 13/586,666, filed Aug. 15, 2012; mailed Jun. 23, 2014.
Final Office Action for U.S. Appl. No. 13/586,666, filed Aug. 15, 2012; mailed Oct. 3, 2014.
Non-Final Office Action for U.S. Appl. No. 13/661,561, filed Oct. 26, 2012; mailed Aug. 13, 2014.

(Continued)

*Primary Examiner* — Mohammad M Ali
(74) *Attorney, Agent, or Firm* — Hovey Williams LLP

(57) ABSTRACT

An evaporative air conditioner system includes a heat exchanger having an inlet and an outlet and a plurality of passageways between the inlet and the outlet; a pump and nozzle assembly for introducing pressurized air and water to the inlet of the heat exchanger to create a mist of water droplets suspended in air; a vacuum assembly for creating a partial vacuum near the outlet of the heat exchanger to draw the mist through the passageways and to the outlet of the heat exchanger to remove heat from the heat exchanger through evaporative cooling; and a transfer mechanism for moving a medium past the heat exchanger to remove heat from the air without permitting the medium to mix with the mist drawn through the heat exchanger.

16 Claims, 2 Drawing Sheets

(56) References Cited

U.S. PATENT DOCUMENTS

| | | | | |
|---|---|---|---|---|
| 6,938,434 | B1 * | 9/2005 | Fair | 62/309 |
| 7,021,078 | B2 * | 4/2006 | Kucera | 62/310 |
| 2005/0072171 | A1 | 4/2005 | Jensen | |
| 2007/0101746 | A1 * | 5/2007 | Schlom et al. | 62/310 |
| 2007/0138662 | A1 * | 6/2007 | Chiu et al. | 261/154 |
| 2008/0302121 | A1 * | 12/2008 | Lindauer | 62/270 |
| 2009/0116980 | A1 * | 5/2009 | Monjes | 417/410.1 |
| 2010/0242517 | A1 * | 9/2010 | Johnson | 62/259.4 |

FOREIGN PATENT DOCUMENTS

| | | | |
|---|---|---|---|
| WO | WO9310404 | A1 | 5/1993 |
| WO | WO2011014540 | A1 | 2/2011 |

OTHER PUBLICATIONS

Final Office Action for U.S. Appl. No. 13/661,561, filed Oct. 26, 2012; mailed Jan. 14, 2015.

* cited by examiner

EVAPORATIVE AIR CONDITIONING SYSTEM

BACKGROUND

The present invention relates to air conditioning systems. More particularly, the invention relates to an improved evaporative type air conditioning system.

Most air conditioning systems use vapor-compression or absorption refrigeration cycles. Although such air conditioning systems are effective at cooling, they use a great deal of energy.

Evaporative type air conditioning systems cool air, liquids, or other mediums with much less energy than vapor-compression and absorption refrigeration systems. Evaporative cooling works by employing water's large enthalpy of vaporization. The temperature of air, especially when dry, can be dropped significantly through phase transition of water from a liquid to a vapor. In dry climates, evaporative cooling also has the added benefit of adding humidity to the conditioned air.

A typical evaporative air conditioner has a water pump that applies water to one or more evaporative cooling pads and a fan or blower that blows ambient air over the pads. The air evaporates the water in the pads and thus removes heat from the air through evaporative cooling. The cool moist air is then delivered to a building or other conditioned space through vents and/or duct work.

Although evaporative air conditioners use less energy than vapor-compression/absorption type systems, they suffer from several distinct disadvantages. For example, evaporative air conditioners often introduce too much humidity into a building, which can be uncomfortable and cause walls, doors, and furniture to swell and metal components to corrode.

Evaporative air conditioners also require large volumes of air to be introduced into a conditioned space, thus requiring equal amounts of air inside the conditioned space to be vented out. This creates drafts and introduces dust and other particles into the space. Air passed over the evaporative pads can be recirculated from inside the building to reduce the required amount of outside air, but air is ideally only allowed to pass through the evaporative pads once because the air loses its cooling effect as it becomes saturated with water (dry air evaporates water more quickly than damp air).

Evaporative cooling can also introduce odors into a conditioned space because the evaporative pads often promote the growth of mold, mildew, and/or bacteria. The fans necessary for the constant exchange of air within the conditioned space can also create excessive fan noise and vibrations.

Indirect evaporative air conditioner systems solve some of the above-described problems by utilizing heat exchangers so that the cooled, moist air never comes into direct contact with the conditioned space. However, known indirect evaporative systems require a great deal of water and are not efficient nor practical in areas of high humidity.

SUMMARY

The present invention solves the above-described problems and provides a distinct advance in the art of evaporative type air conditioning systems. More particularly, the present invention provides an improved evaporative type air conditioning system that does not introduce excessive humidity into a conditioned space; is not susceptible to mold, mildew, and/or bacteria growth; does not introduce excessive outdoor air into the conditioned space; and is more efficient and effective than existing indirect evaporative air conditioning systems.

The present invention provides improved evaporative cooling with a technology called "Accelerated Hyper-Evaporation". As described in more detail below, Accelerated Hyper-Evaporation creates a dense mist of microscopic water droplets suspended in air then rapidly draws or forces the mist and ambient air through a metal heat exchanger under the influence of pressurized air or a vacuum source. This causes water in the mist to rapidly evaporate and cool the heat exchanger so the heat exchanger can cool air or any other medium passed over or through the heat exchanger.

An evaporative air conditioner system constructed in accordance with one exemplary embodiment of the invention broadly comprises: a heat exchanger; a pump and nozzle assembly; an air vent; pressured air blower and/or a vacuum assembly; a transfer mechanism; and a control system. The system may include other components that are described in the Detailed Description section of the application below.

The heat exchanger isolates the water used for evaporative cooling from the air introduced in the conditioned space to prevent humidity from being added to the conditioned space. An embodiment of the heat exchanger has an inlet, an outlet, and a plurality of passageways between the inlet and the outlet. The passageways are preferably formed from metal tubes that do not promote mold, mildew, and bacteria growth. The heat exchanger may be an air-to-vapor (ATV) type heat exchanger or a liquid-to-vapor (LTV) type heat exchanger.

The pump and nozzle assembly provides the air and water used to cool the heat exchanger through evaporative cooling. In one embodiment, the assembly introduces and mixes pressurized air and water at the inlet of the heat exchanger to create a mist of water droplets suspended in air. The pump and nozzle assembly may comprise one or more high pressure water nozzles and a water pump for delivering water at 400 to 50,000 psi to the water nozzles and one or more high pressure air nozzles and an air pump or other source of pressurized air for delivering pressurized air at 25-1000 psi to the air nozzles.

The air vent introduces pressurized or non-pressurized ambient air to the inlet of the heat exchanger for mixing with the mist from the pump and nozzle assembly. The amount of ambient air drawn into the heat exchanger may be regulated by a motor driven damper.

The vacuum assembly creates a partial vacuum near the outlet of the heat exchanger to rapidly draw the mist and ambient air through the heat exchanger and/or a blower may force ambient air into the inlet. This removes heat from the heat exchanger through evaporative cooling.

The transfer mechanism moves air, liquid, or any other medium over or through the heat exchanger to cool the air or other medium. The cooled air or other medium is then used to cool a conditioned space served by the air conditioner. Importantly, the transfer mechanism and heat exchanger do not permit the air or other medium used to cool the conditioned space to mix with the mist drawn through the heat exchanger so no humidity is added to the air delivered to the conditioned space.

The control system operates the components of the air conditioner to optimize the performance and efficiency of the air conditioner. In some embodiments, the control system may operate the air conditioner in a number of stages. For example, in one embodiment, the control system operates the air conditioner in a first stage when ambient temperatures are below a threshold temperature and a second stage when ambient temperatures are above the threshold temperature. In the second stage, the high pressure air nozzle may be activated to provide maximum cooling. In the first stage, the air nozzle may be turned off when less cooling is required. In another embodiment, the control system operates the air conditioner in four stages, including: $1^{st}$ stage—low pressure (variable) water, low speed (variable) vacuum and/or blower; $2^{nd}$ stage—medium pressure (variable) water, medium speed (variable) vacuum and/or blower; $3^{rd}$ stage—high pressure (variable water, high pressure (variable) vacuum and/or blower; and $4^{th}$ stage—high pressure (variable) water, high pressure (variable) vacuum and/or blower, compressed air.

The above described evaporative air conditioner system provides numerous advantages over existing air conditioner systems. For example, the air conditioner does not introduce excessive humidity into the conditioned space; is not susceptible to mold, mildew, and/or bacteria growth; and does not introduce excessive outdoor air into the conditioned space. The air conditioner system of the present invention also allows the conditioned air to be recirculated from within the conditioned space and filtered, purified, sterilized, humidified, and/or zoned.

The air conditioner of the present invention is also more efficient and effective than existing indirect evaporative air conditioning systems. For example, by mixing ambient air, pressurized air, and pressurized water at the inlet of the heat exchanger, the pump and nozzle assembly creates a dense atomized mist that can be evaporated more quickly than water soaked in an evaporative pad. Then, by rapidly drawing and/or forcing the mist through the heat exchanger under air and/or vacuum pressure, a large volume of the mist quickly evaporates to rapidly remove heat from the heat exchanger at a significantly faster rate than evaporation in conventional evaporative type air conditioners.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
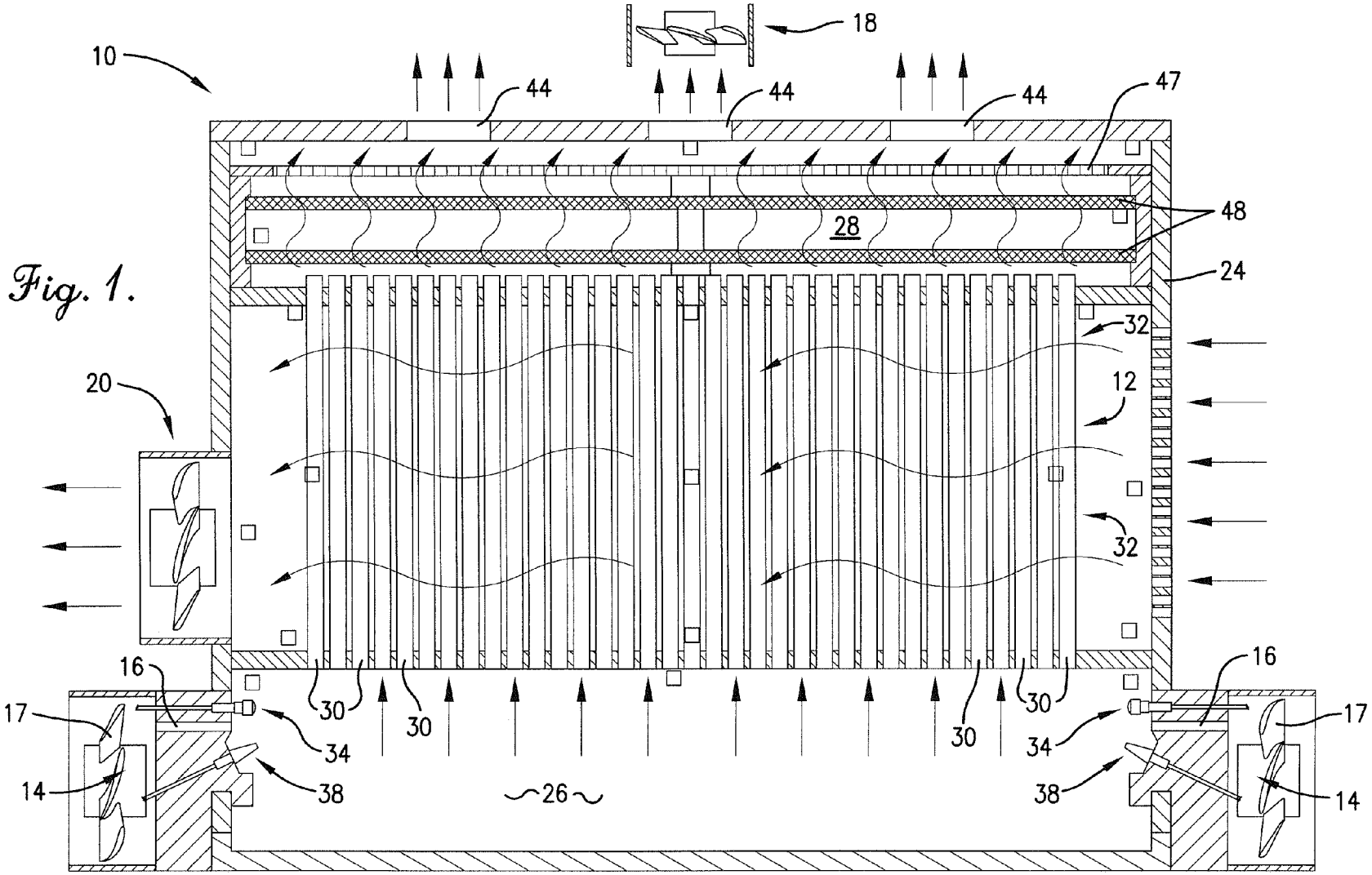
FIG. 1 is a schematic diagram of components of an air conditioner system constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, an evaporative air conditioner system 10 constructed in accordance with an embodiment of the invention is illustrated. The air conditioner system 10 cools air via advanced evaporative cooling techniques and may be used to cool a house, office building, or any other conditioned space. The air conditioner system 10 employs a technology invented by the applicant called "Accelerated Hyper-Evaporation". Accelerated Hyper-Evaporation creates a dense mist of microscopic water droplets in suspended in air then rapidly forces or draws the mist and ambient air through a metal heat exchanger under the influence of pressured air or a vacuum source. This causes water in the mist to rapidly evaporate and cool the heat exchanger so the heat exchanger can in turn chill air or any other medium passed over or through the heat exchanger (depending whether it's an air-to-vapor (ATV) or liquid-to-vapor (LTV) heat exchanger).

Figure 2:
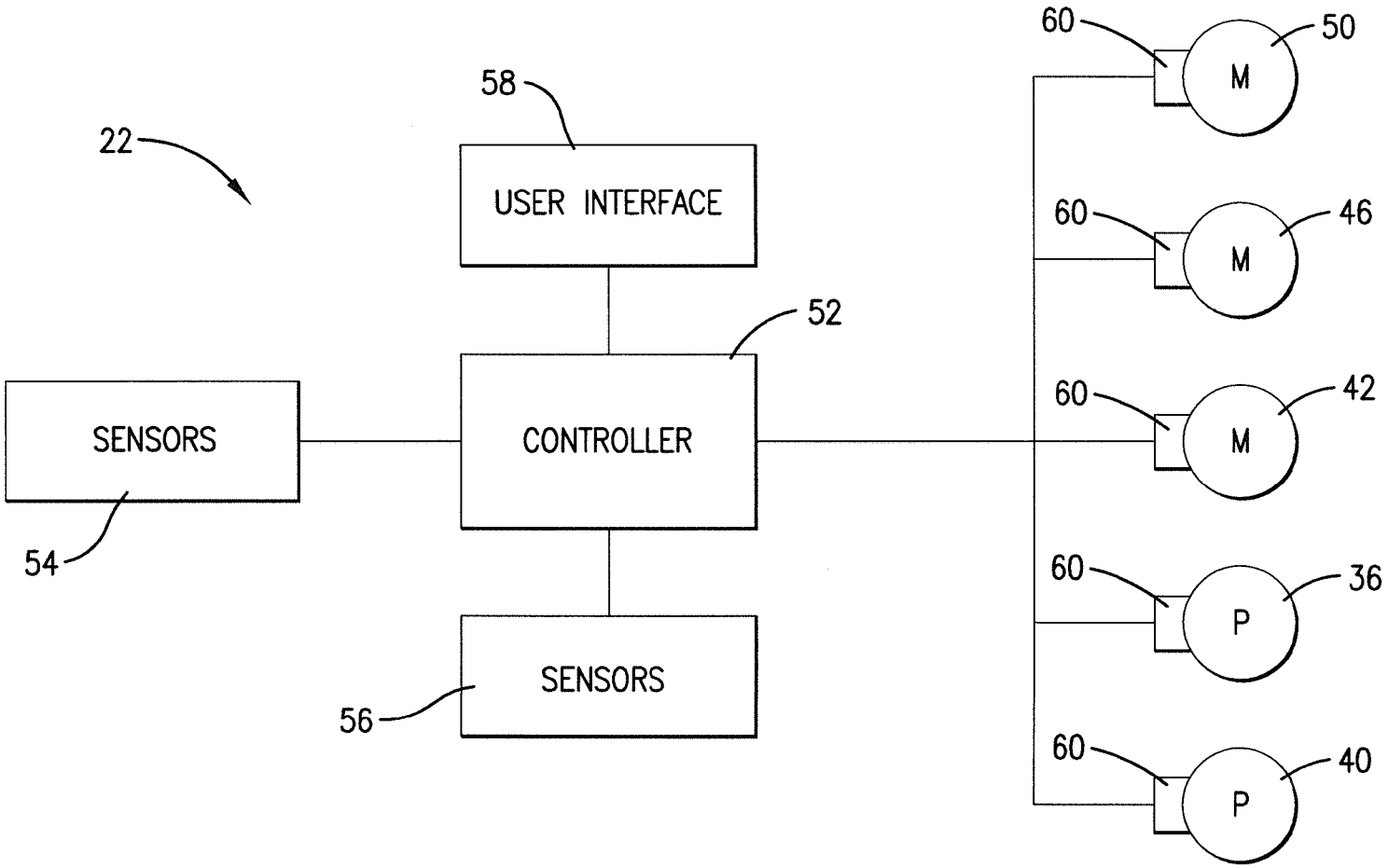
FIG. 2 is a block diagram of components of the control system of the air conditioner system.

As shown primarily in FIG. 1, an air conditioner system 10 constructed in accordance with an exemplary embodiment of the invention broadly comprises: a heat exchanger 12; a pump and nozzle assembly 14; an air vent 16; a vacuum assembly 18 and/or air blower 17; and a transfer mechanism 20. As shown in FIG. 2, the system 10 also includes a control system 22.

The heat exchanger 12 isolates water used for evaporative cooling from the conditioned air introduced into the conditioned space as is conventional in indirect evaporative air conditioner systems. The heat exchanger 12 and other components of the air conditioner may be enclosed within a cabinet, housing, or other enclosure 24. The enclosure 24 defines an inlet area 26 on one side of the heat exchanger 12 and an outlet area 28 on an opposite side of the heat exchanger.

The heat exchanger also has a plurality of passageways 30 formed between the inlet area 26 and the outlet area 28 for the passage of water and air introduced in the inlet area 26. The passageways 30 are preferably formed from metal tubes that do not promote mold, mildew, and bacteria growth. The tubes and hence the passageways may be between 12 and 48 inches long, with a preferred length of 24 inches. The heat exchanger also has spaces or air channels 32 transverse to the passageways 30 for the passage of air or another medium used to cool the conditioned space. The heat exchanger may be an air-to-vapor (ATV) type heat exchanger as illustrated or a liquid-to-vapor (LTV) type heat exchanger.

The pump and nozzle assembly 14 introduces pressurized air and water to the inlet area 26 of the heat exchanger 12 for cooling the heat exchanger. In one embodiment, the pump and nozzle assembly comprises one or more high pressure water nozzles 34 and a water pump 36 for delivering pressurized water to the water nozzles. The water nozzles 34 are preferably positioned closer to the heat exchanger 12 and disperse pressurized water across the inlet area. The pump 36 may deliver water to the nozzles at 400-50,000 psi, with an ideal pressure of 1,000-5,000 psi. The number of water nozzles 34 depends on the size of the heat exchanger 12 and the cooling needs of the conditioned space. For most typical applications, ten water nozzles 34 are provided.

The pump and nozzle assembly 14 also comprises one or more high pressure air nozzles 38 and an air pump 40 or other source of pressurized air for delivering pressurized air to the air nozzles. The air nozzles 38 are preferably positioned below the water nozzles 34 and angled upwardly to direct pressurized air into the streams of water provided by the water nozzles 34. This mixes the air and water into a dense mist of microscopic water droplets suspended in air. The air pump 40 may deliver air to the nozzles at 25-1,000 psi, with an ideal pressure of 100-300 psi. As with the water nozzles 34, the number of air nozzles 38 depends on the size of the heat exchanger 12 and the cooling needs of the conditioned space. In one embodiment, ten air nozzles 38 are provided.

The air vent 16 introduces pressurized or non-pressurized ambient air to the inlet 26 of the heat exchanger 12 for mixing with the mist and evaporating the water in the mist. The air vent 16 may be positioned anywhere on the inlet area 16 side of the heat exchanger 12 and may be connected to duct work, hoses, etc. that draw ambient air from an outside area. The air vent 16 may also be coupled to a motorized damper 42 for regulating the amount of ambient air introduced in the inlet area 26. An optional pressure air blower 17 may be provided to force ambient air into the air vent 16.

The vacuum assembly 18 creates a partial vacuum near the outlet area 28 of the heat exchanger 12 to rapidly draw the mist and ambient air through the passageways 30 and out of the enclosure 24. As the mist and ambient air is drawn through the heat exchanger 12, the ambient air evaporates the water suspended in the mist to remove heat from the heat exchanger 12 through evaporative cooling.

In one embodiment, the vacuum assembly 18 comprises one or more fans, blowers, etc., that are connected to discharge ports 44 or vents near the outlet area of the heat exchanger. The fans, blowers, etc. are driven by one or more motors 46. The motor or motors 46 may be multi-speed or variable speed motors so that the control system 22 may select the optimum level of vacuum pressure for a given cooling load and current ambient temperatures and humidity. Applicant has discovered that a vacuum pressure of 0.01 to 15 in Hg is desirable for most applications, with a vacuum pressure nearer the lower range for low cooling requirements and nearer the higher range for higher cooling requirements.

A vacuum equalizer plate 47 with a plurality of equally-sized and spaced openings may be positioned between the vacuum discharge ports 44 and the outlet area 28 of the heat exchanger 12 to equalize the vacuum pressure across all the heat exchanger passageways 30. A moisture extractor 48 may be positioned below the vacuum equalizer plate 47 to extract moisture from the air pulled through the heat exchanger and to direct the moisture back to the inlet area 26 of the heat exchanger to reduce the water requirements of the air conditioner system.

A condensation reservoir or sump may be provided in the bottom of the enclosure 24 for collecting water condensation from the inlet area 26 and re-introducing the water to the pump 36.

The transfer mechanism 20 moves air, liquid, or other medium through the passageways 32 of the heat exchanger 12 without permitting the air or other medium to mix with the mist drawn through the passageways 30 of the heat exchanger. This removes heat from the air passing over the heat exchanger without adding humidity to the air. The transfer mechanism 20 may be a blower, fan, pump, or any other similar mechanism and may be driven by one or more motors 50.

The control system 22 operates the other components of the air conditioner system 10 to optimize the performance and efficiency of the system. An embodiment of the control system may include a controller 52, one or more external sensors 54, one or more internal sensors 56, a user interface 58, and circuitry 60 coupled with the pumps and motors 36, 40, 42, 46, 50.

The controller 52 may be a microcontroller, application specific integrated circuit (ASIC), computer, or any other computing device or control circuit capable of implementing logical functions. The controller 52 may be pre-programmed at the factory to operate the air conditioner system in a particular manner based on data received form the external sensors 54 and internal sensors 56 or may be user-configured with the user interface 58.

The external sensors 54 may comprise a thermostat, enthalpy sensor, humidity sensor, and/or other environmental sensors for sensing outside ambient temperatures and humidity levels. Likewise, the internal sensors 56 may comprise a thermostat, enthalpy sensor, humidity sensor, and/or other environmental sensors for sensing temperatures and humidity levels inside the conditioned space. The user interface 58 may include any combination of buttons, switches, keypads, touchscreen displays, etc. and may be incorporated in the controller 52 or be a stand-alone device.

The circuitry 60 may include relays, switches, variable speed drives, or other components capable of controlling the pumps 36, 40 connected to the water nozzles 34 and air nozzles 38 and the motors 42, 46, 48 connected to the air vent 16, the optional pressured air blower 17, the vacuum 18, and the transfer mechanism 20. The circuitry 60 communicates with and is controlled by the controller 52.

In one embodiment, the controller 52 receives data representative of an ambient outside temperature and humidity level from the external sensors 54, data representative of an inside temperature and humidity level from the internal sensors 56, and a desired set point temperature and/or humidity level from the user interface 58, and then controls operation of the air conditioner to achieve optimum cooling and efficiency based on this data.

In some embodiments, the control system may operate the air conditioner in a number of stages. For example, when the outside environment is extremely hot and/or humid and a user has called for a low inside temperature, the controller 52 may: (1) operate the motors 46, 50 at full speed to provide maximum vacuum and/or blower pressure at the outlet area 28 of the heat exchanger and maximum air speed across the heat exchanger; (2) open the vents 16 completely to provide a maximum amount of ambient air at the inlet of the heat exchanger; (3) operate the air pumps 40 at maximum speed to provide maximum air pressure to the air nozzles 38; and (4) operate the water pumps 36 at full speed to provide maximum water pressure at the water nozzles 34. This creates maximum cooling of the heat exchanger 12 until a desired set point temperature is reached within the conditioned space.

In contrast, when the outside environment is less hot and/or humid, the controller 52 may: (1) operate the motors 46, 50 at a lower speed to provide less vacuum and/or blower pressure at the outlet of the heat exchanger and a lower air speed across the heat exchanger; (2) open the vents 16 only partially to provide less ambient air at the inlet of the heat exchanger; (3) operate the air pumps at a reduced speed to provide a lower air pressure to the air nozzles 38; and (4) operate the water pumps at a reduced speed to provide less water pressure at the water nozzles. This creates a lower rate of cooling of the heat exchanger until a desired set point temperature is reached within the conditioned space.

In another embodiment, the control system 22 operates the air conditioner system 10 in a first stage when ambient temperatures are below a threshold temperature and a second stage when ambient temperatures are above the threshold temperature. The control system 22 activates the high pressure air nozzle in the second stage but not in the first stage.

In another embodiment, the control system operates the air conditioner in four stages, including: $1^{st}$ stage—low pressure (variable) water, low speed (variable) vacuum and/or blower; $2^{nd}$ stage—medium pressure (variable) water, medium speed (variable) vacuum and/or blower; $3^{rd}$ stage—high pressure (variable water, high pressure (variable) vacuum and/or blower; and $4^{th}$ stage—high pressure (variable) water, high pressure (variable) vacuum and/or blower, compressed air.

The above described evaporative air conditioner system 10 provides numerous advantages over existing air conditioner systems. For example, the air conditioner does not introduce excessive humidity into a conditioned space; is not susceptible to mold, mildew, and/or bacteria growth; and does not introduce excessive outdoor air into the conditioned space. The air conditioner system 10 also allows the conditioned air to be recirculated from within the conditioned space and filtered, purified, sterilized, humidified, and/or zoned.

The air conditioner 10 is also more efficient and effective than existing indirect evaporative air conditioning systems. For example, by mixing ambient air, pressurized air, and pressurized water at the inlet of the heat exchanger, the pump and nozzle assembly creates a dense atomized mist that can be evaporated more quickly than water soaked in an evaporative pad. Then, by rapidly drawing the mist through the heat exchanger under vacuum pressure, a large volume of the mist quickly evaporates to rapidly remove heat from the heat exchanger at a significantly faster rate than evaporation in conventional evaporative type air conditioners.

Although the invention has been described with reference to the preferred embodiment illustrated in the attached drawing figures, it is noted that equivalents may be employed and substitutions made herein without departing from the scope of the invention as recited in the claims. For example, the specific components of the air conditioner system 10 described and illustrated herein may be replaced and/or supplemented with equivalent components.

Having thus described the preferred embodiment of the invention, what is claimed as new and desired to be protected by Letters Patent includes the following:

The invention claimed is:

1. An evaporative air conditioner system comprising:

a heat exchanger having an inlet area and an outlet area and a plurality of passageways between the inlet area and the outlet area;

a pump and nozzle assembly for introducing pressurized air and water to the inlet area of the heat exchanger to create a mist of water droplets suspended in air;

a vacuum assembly or blower for creating a partial vacuum near the outlet area of the heat exchanger to draw the mist through the passageways and to the outlet area to remove heat from the heat exchanger through evaporative cooling; and a transfer mechanism for moving a medium past the heat exchanger to remove heat from the medium without permitting the medium to mix with the mist drawn through the heat exchanger.

2. The air conditioner system of claim 1, wherein the medium is air, the transfer mechanism is a fan or blower, and the evaporator is an air to vapor heat exchanger.

3. The air conditioner system of claim 1, wherein the medium is liquid, the transfer mechanism is a pump, and the evaporator is a liquid to vapor heat exchanger.

4. The air conditioner system of claim 1, wherein the pump and nozzle assembly comprises:

a high pressure water nozzle and a water pump for delivering pressurized water to the water nozzle; and a high pressure air nozzle and an air pump for delivering pressurized air to the air nozzle.

5. The air conditioner system of claim 4, further comprising an air vent for introducing pressurized and non-pressurized ambient air to the inlet area of the heat exchanger for mixing with the mist drawn through the heat exchanger.

6. The air conditioner system of claim 1, further comprising a condensation reservoir for collecting water condensation and re-introducing the water condensation to the pump for the high pressure water nozzle.

7. The air conditioner system of claim 1, wherein the passageways formed between the inlet area and the outlet area of the heat exchanger are formed with spaced-apart metal tubes.

8. The air conditioner system of claim 4, further comprising a control system for operating the air conditioner in a first stage when ambient temperatures are below a threshold temperature and a second stage when ambient temperatures are above the threshold temperature, wherein the control system activates the high pressure air nozzle in the second stage but not in the first stage.

9. An evaporative air conditioner system comprising:

a heat exchanger having an inlet and an outlet and a plurality of passageways formed from metal tubes between the inlet and the outlet;

a pump and nozzle assembly for introducing pressurized air and water to the inlet of the heat exchanger to create a mist of water droplets suspended in air;

an air vent for introducing pressurized or non-pressurized air to the inlet of the heat exchanger for mixing with the mist;

pressured forced air blower and/or a vacuum assembly for creating a partial vacuum near the outlet of the heat exchanger to force or draw the mist and non-pressurized air through the passageways and to the outlet of the heat exchanger to remove heat from the heat exchanger through evaporative cooling; and an air mover for moving air over the heat exchanger without permitting the air to mix with the mist drawn through the heat exchanger to remove heat from the air without adding humidity to the air.

10. The air conditioner system of claim 9, wherein the evaporator is an air to vapor heat exchanger.

11. The air conditioner system of claim 9, wherein the evaporator is a liquid to vapor heat exchanger.

12. The air conditioner system of claim 9, wherein the pump and nozzle assembly comprises:

a high pressure water nozzle and a water pump for delivering pressurized water to the water nozzle; and a high pressure air nozzle and a source of pressurized air for delivering pressurized air to the air nozzle.

13. The air conditioner system of claim 9, further comprising a condensation reservoir for collecting water condensation and re-introducing the water condensation to the pump for the high pressure water nozzle.

14. The air conditioner system of claim 12, further comprising a control system for operating the air conditioner in a first stage when ambient temperatures are below a threshold temperature and a second stage when ambient temperatures are above the threshold temperature, wherein the control system activates the high pressure air nozzle in the second stage but not in the first stage.

15. An evaporative air conditioner system comprising:

a heat exchanger having an inlet and an outlet and a plurality of passageways formed from metal tubes between the inlet and the outlet;

a pump and nozzle assembly for introducing pressurized air and water to the inlet of the heat exchanger to create a mist of water droplets suspended in air, the pump and nozzle assembly comprising:

a high pressure water nozzle and a water pump for delivering water at 1,000-4,000 psi to the water nozzle; and a high pressure air nozzle and a source of pressurized air for delivering pressurized air at 100-500 psi to the air nozzle;

an air vent for introducing non-pressurized air to the inlet of the heat exchanger for mixing with the mist;

a vacuum assembly for creating a partial vacuum near the outlet of the heat exchanger to draw the mist and pressurized or non-pressurized air through the passageways and to the outlet of the heat exchanger to remove heat from the heat exchanger through evaporative cooling;

an air mover for moving air over the heat exchanger without permitting the air to mix with the mist drawn through the heat exchanger to remove heat from the air without adding humidity to the air; and a control system for operating the air conditioner in a first stage when ambient temperatures are below a threshold temperature and a second stage when ambient temperatures are above the threshold temperature, wherein the control system activates the high pressure air nozzle in the second stage but not in the first stage.

16. The air conditioner system of claim 15, further comprising a condensation reservoir for collecting water condensation re-introducing the water condensation to the pump for the high pressure water nozzle.

* * * * *